US012791235B2

(12) United States Patent
Shin et al.

(10) Patent No.: US 12,791,235 B2
(45) Date of Patent: Nov. 10, 2026

(54) HEAT EXCHANGER FOR VEHICLE

(71) Applicant: ESTRA AUTOMOTIVE SYSTEMS CO., LTD., Daegu (KR)

(72) Inventors: Young Sam Shin, Daegu (KR); Jeong Kyu Park, Daegu (KR); Jun Ho Choi, Daegu (KR)

(73) Assignee: ESTRA AUTOMOTIVE SYSTEMS CO., LTD., Daegu (KR)

( * ) Notice: Subject to any disclaimer, the term of this patent is extended or adjusted under 35 U.S.C. 154(b) by 141 days.

(21) Appl. No.: 18/033,401

(22) PCT Filed: Oct. 22, 2021

(86) PCT No.: PCT/KR2021/014919

§ 371 (c)(1),
(2) Date: Apr. 24, 2023

(87) PCT Pub. No.: WO2022/092715

PCT Pub. Date: May 5, 2022

(65) Prior Publication Data

US 2024/0044581 A1 Feb. 8, 2024

(30) Foreign Application Priority Data

Oct. 26, 2020 (KR) ..... 10-2020-0139597

(51) Int. Cl.

| | |
|---|---|
| ***F25B 39/04*** | (2006.01) |
| ***F28D 9/00*** | (2006.01) |
| ***F28F 3/08*** | (2006.01) |

(52) U.S. Cl.

CPC ..... *F25B 39/04* (2013.01); *F28D 9/005* (2013.01); *F28D 9/0062* (2013.01); *F28F 3/086* (2013.01);

(Continued)

(58) Field of Classification Search

CPC ..... F28D 9/005; F25B 2339/044; F25B 2339/043; F25B 2400/16; F25B 39/04;

(Continued)

(56) References Cited

U.S. PATENT DOCUMENTS 5,901,573 A * 5/1999 Kobayashi ..... B60H 1/3227 62/509
10,024,602 B2 * 7/2018 Nyander ..... F28F 3/046

(Continued)

FOREIGN PATENT DOCUMENTS

DE 102011007701 A1 * 10/2012 ..... F28D 9/005
DE 102011078136 A1 * 12/2012 ..... F25B 39/04

(Continued)

OTHER PUBLICATIONS

International Search Report for PCT/KR2021/014919 dated Jan. 20, 2022.

*Primary Examiner* — Jianying C Atkisson
*Assistant Examiner* — For K Ling
(74) *Attorney, Agent, or Firm* — Sughrue Mion, PLLC

(57) ABSTRACT

A heat exchanger for vehicles includes: a plurality of first stacked plates forming a condensing portion in which a refrigerant is condensed through heat exchange between a coolant and the refrigerant; a receiver container for storing the refrigerant passing through the condensing portion; a plurality of second stacked plates forming a sub-cooling portion for cooling the refrigerant through heat exchange between the coolant and the refrigerant discharged from the receiver container; and an intermediate plate between the first stacked plates and the second stacked plates and comprising through holes through which the refrigerant and the coolant respectively move.

3 Claims, 16 Drawing Sheets

(52) U.S. Cl.
CPC ... *F25B 2339/043* (2013.01); *F25B 2339/044* (2013.01)

(58) Field of Classification Search
CPC ..... F25B 2339/0441; F25B 2339/0442; F25B 2339/0443; F25B 2339/0444
See application file for complete search history.

(56) References Cited

U.S. PATENT DOCUMENTS

| | | | | |
|---|---|---|---|---|
| 10,254,022 | B2 * | 4/2019 | Citti | F25B 39/00 |
| 10,408,543 | B2 * | 9/2019 | Barfknecht | F28D 9/0093 |
| 10,935,288 | B2 * | 3/2021 | Rhee | F25B 40/02 |
| 2002/0083735 | A1 * | 7/2002 | Neumann | F28D 1/05375 62/509 |
| 2008/0196874 | A1 * | 8/2008 | Bertilsson | F28D 9/005 165/167 |
| 2015/0226469 | A1 * | 8/2015 | Hofmann | F28D 9/00 62/506 |
| 2015/0323231 | A1 * | 11/2015 | Citti | F28D 9/005 62/516 |
| 2016/0161160 | A1 * | 6/2016 | Hofmann | F28F 9/0253 62/509 |
| 2016/0320141 | A1 | 11/2016 | Barfknecht et al. | |
| 2019/0063800 | A1 * | 2/2019 | Rhee | F25B 39/00 |
| 2019/0264984 | A1 | 8/2019 | Takagi et al. | |
| 2020/0224943 | A1 * | 7/2020 | Sus | F25B 39/00 |
| 2022/0136745 | A1 * | 5/2022 | Kawaguchi | F25B 39/04 165/104.21 |

FOREIGN PATENT DOCUMENTS

| | | | | | |
|---|---|---|---|---|---|
| EP | 2927631 | A1 | * | 10/2015 | F25B 39/04 |
| EP | 2784425 | B1 | * | 5/2016 | F25B 39/04 |
| FR | 3045803 | A1 | * | 6/2017 | F25B 39/04 |
| FR | 3059400 | A1 | * | 6/2018 | |
| JP | 06194005 | A | * | 7/1994 | B60H 1/32 |
| JP | 09-195941 | A | | 7/1997 | |
| JP | H09184668 | A | * | 7/1997 | |
| JP | H11325788 | A | * | 11/1999 | F25B 39/04 |
| JP | H11351702 | A | * | 12/1999 | F28F 9/0246 |
| JP | 2001208450 | A | * | 8/2001 | F25B 39/04 |
| JP | 2020-016379 | A | | 1/2020 | |
| JP | 2020-085339 | A | | 6/2020 | |
| JP | 2021014973 | A | * | 2/2021 | F25B 39/00 |
| KR | 10-1909658 | B1 | | 10/2018 | |
| KR | 10-2019-0046722 | A | | 5/2019 | |
| KR | 10-2166920 | B1 | | 10/2020 | |
| KR | 10-2315648 | B1 | | 10/2021 | |
| WO | WO-2013084469 | A1 | * | 6/2013 | F28F 1/128 |
| WO | WO-2020110638 | A1 | * | 6/2020 | |

* cited by examiner

【FIG. 1】
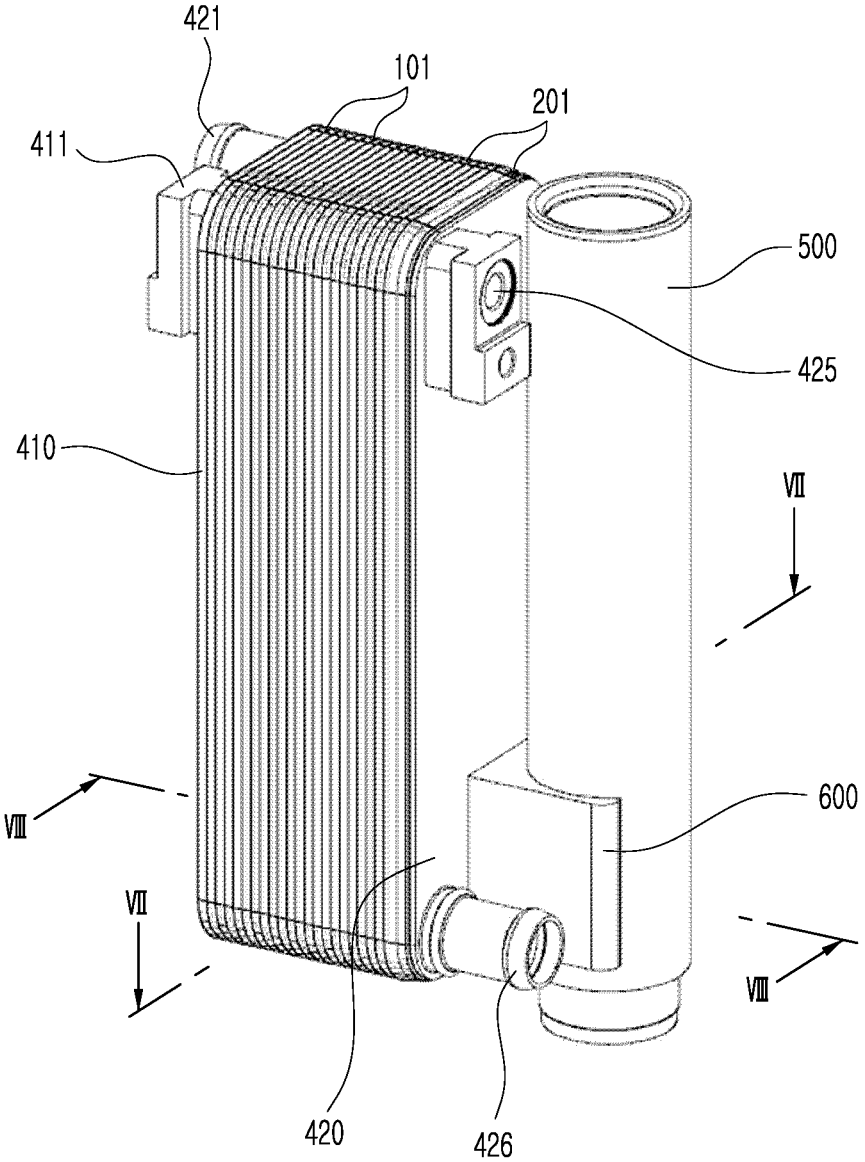

【FIG. 2】
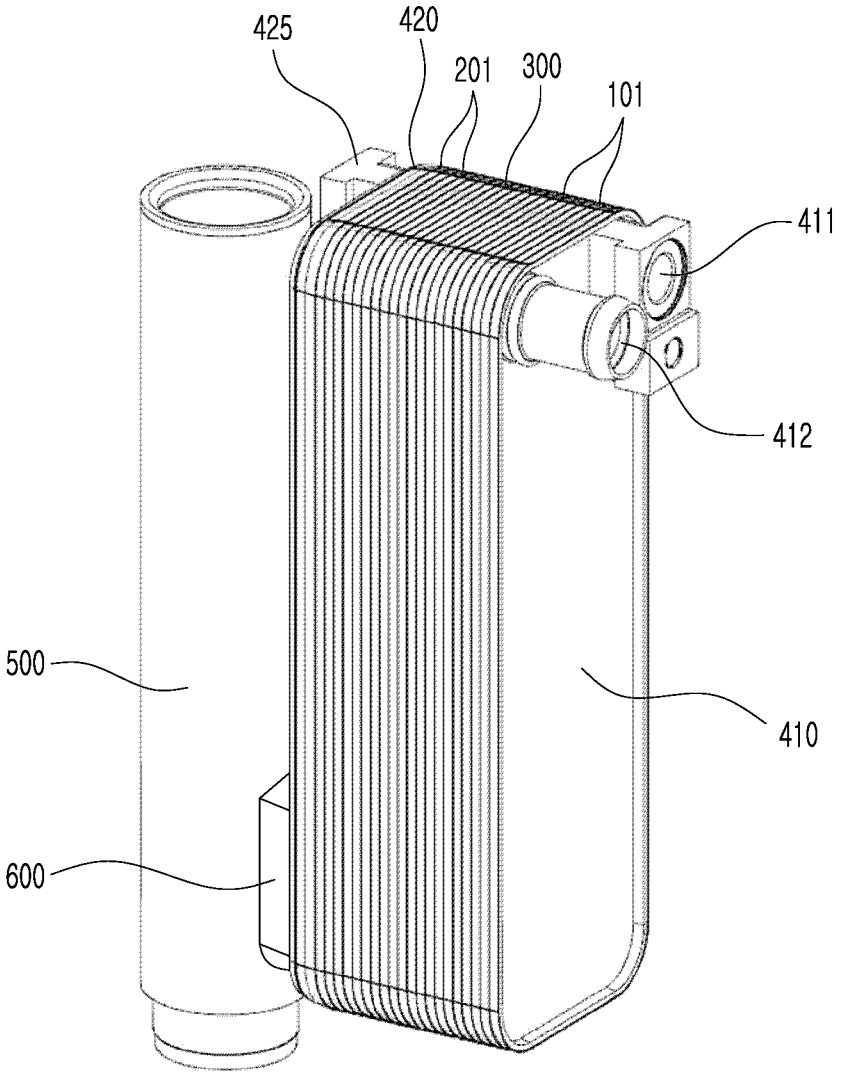

【FIG. 3】
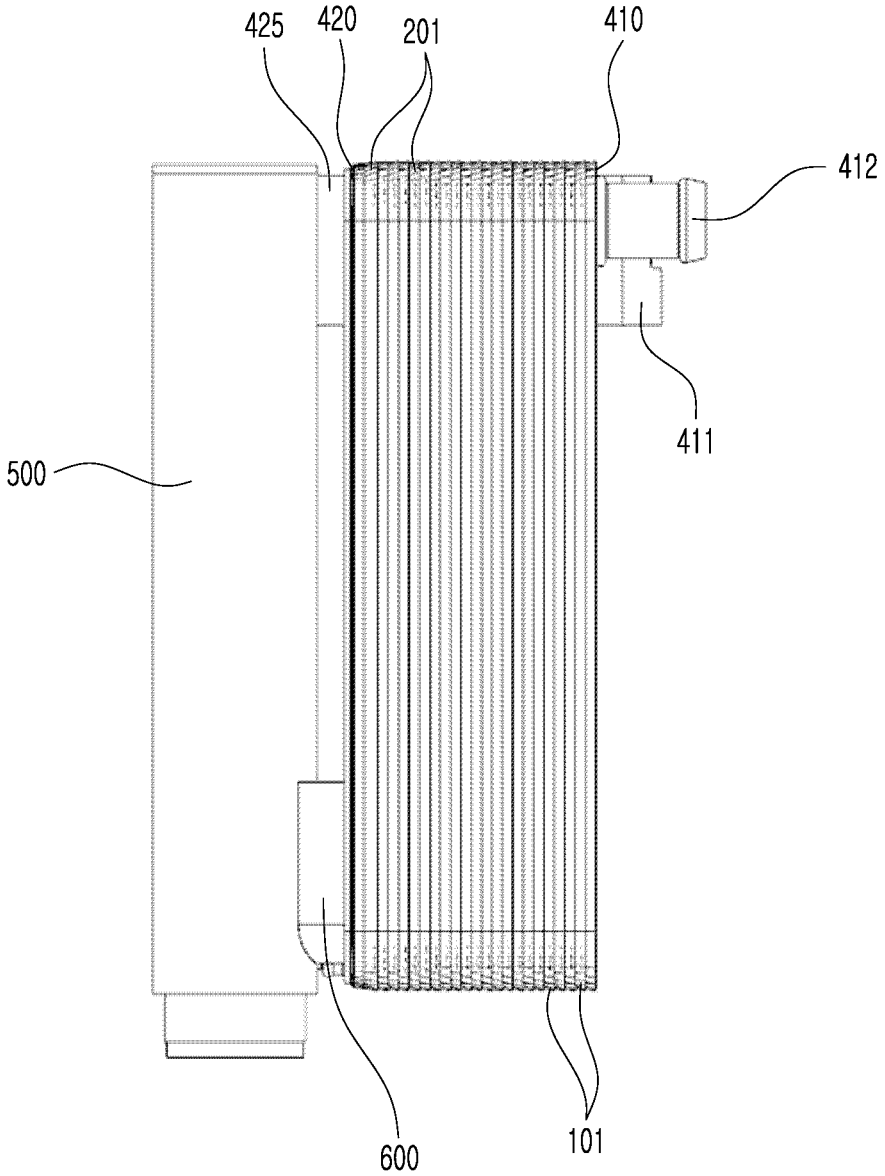

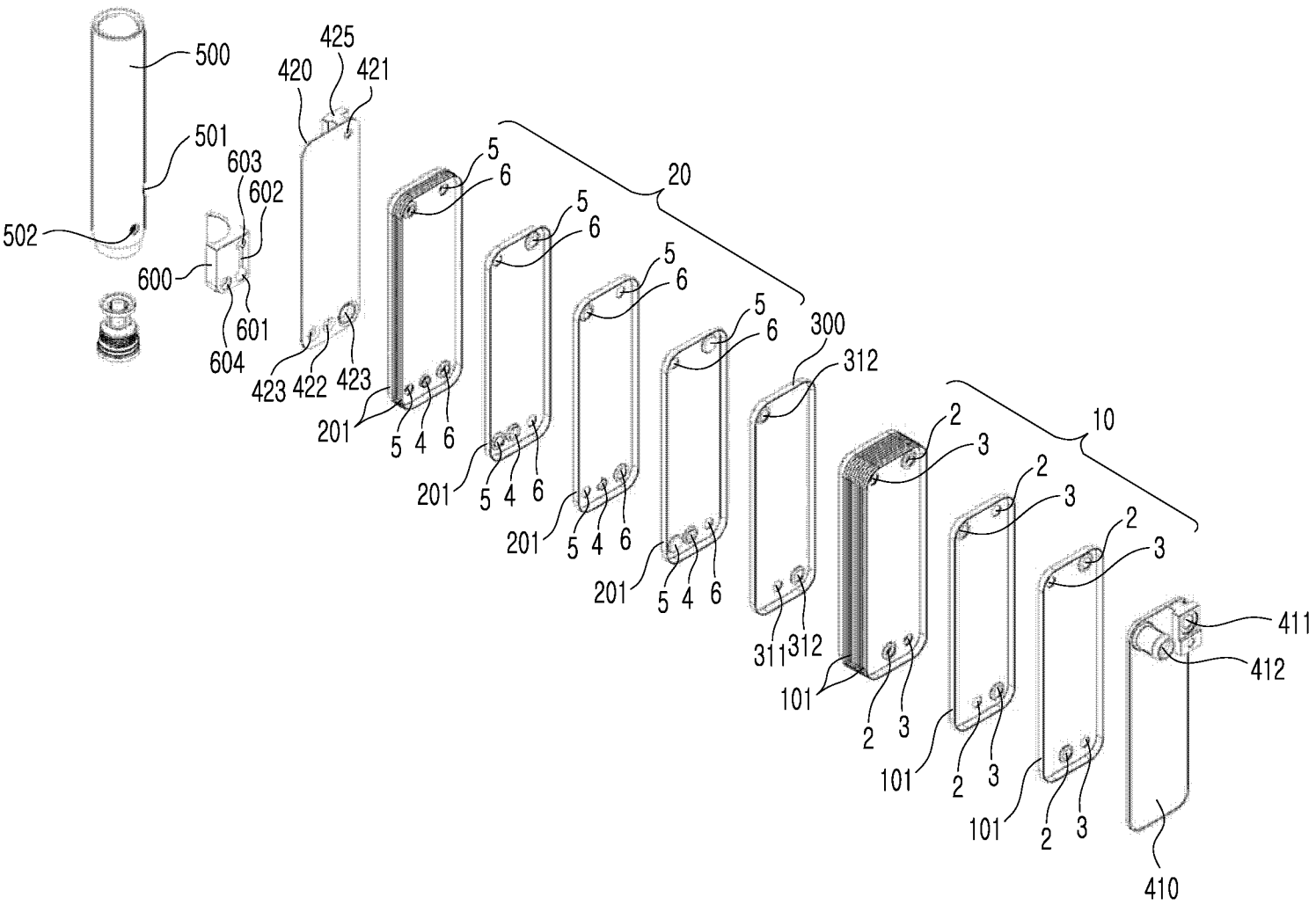
[FIG. 4]

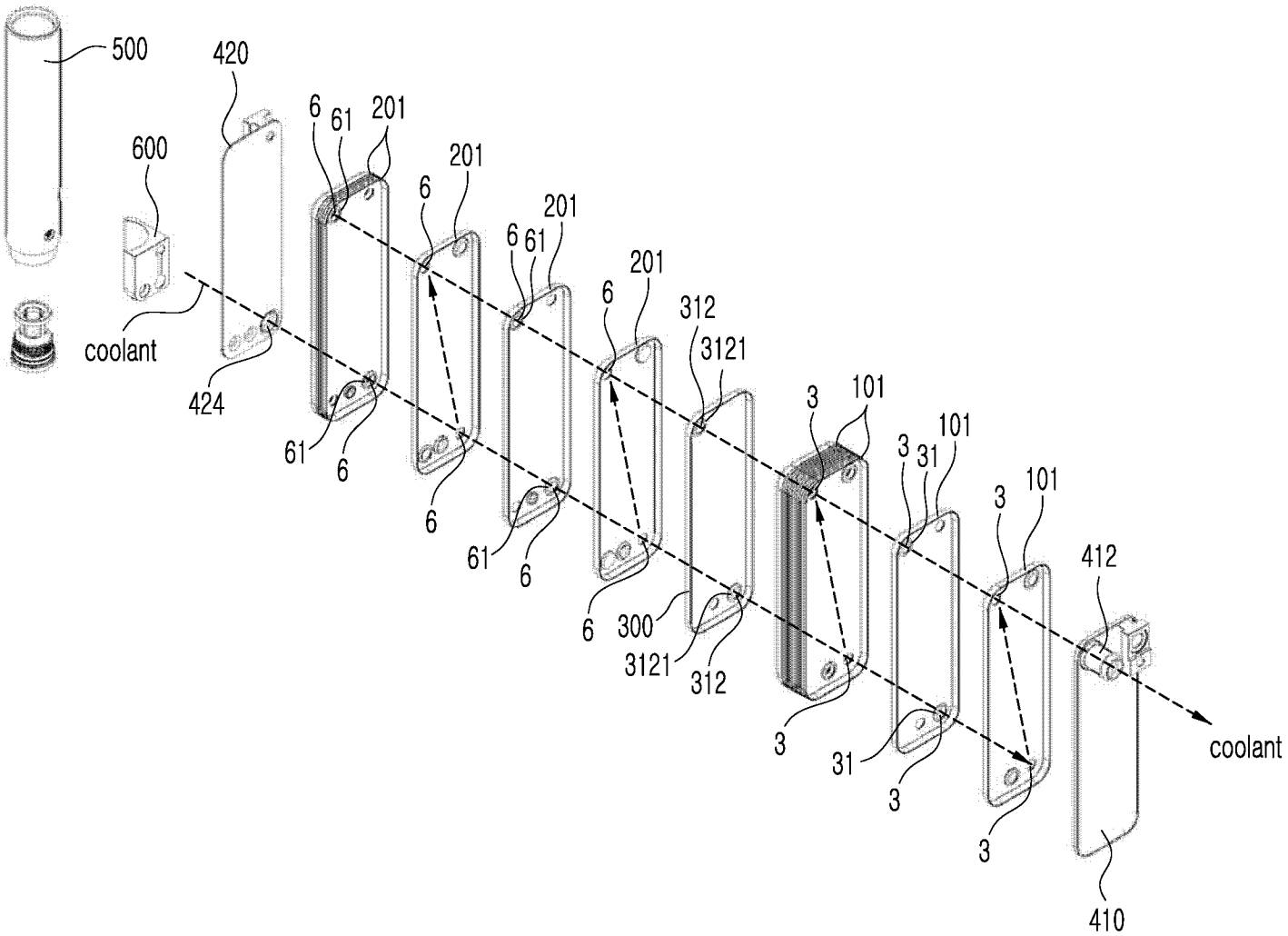
[FIG. 5]

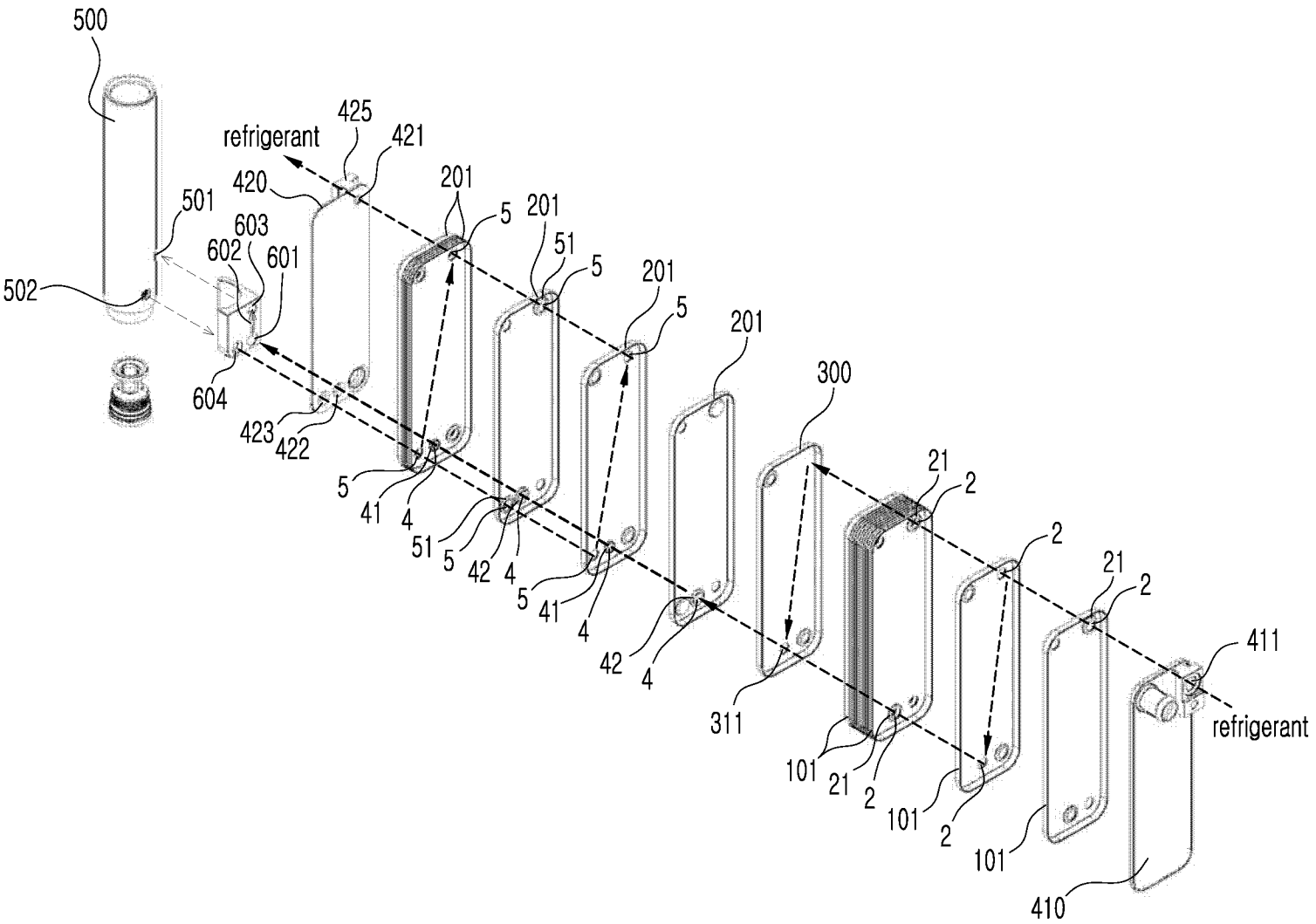
[FIG. 6]

【FIG. 7】
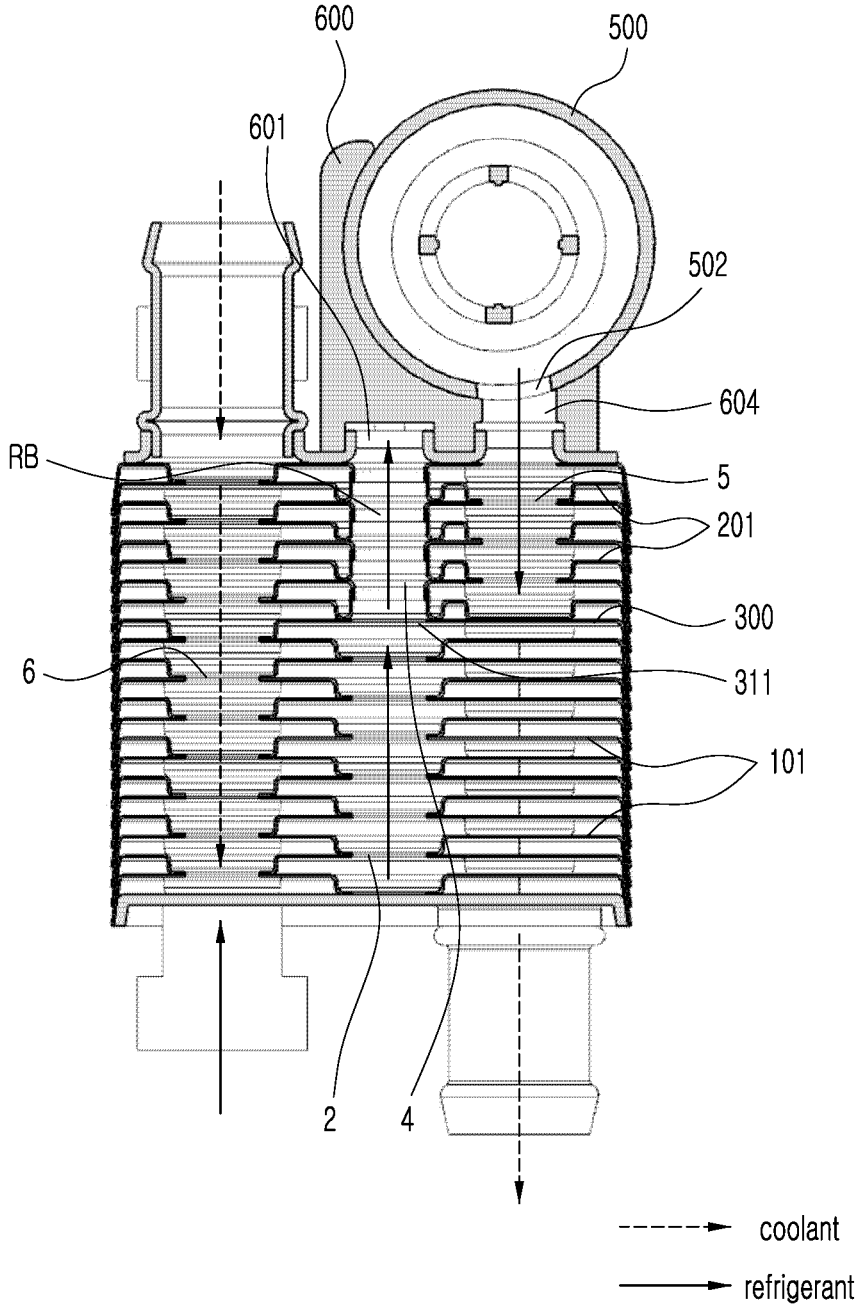

【FIG. 8】
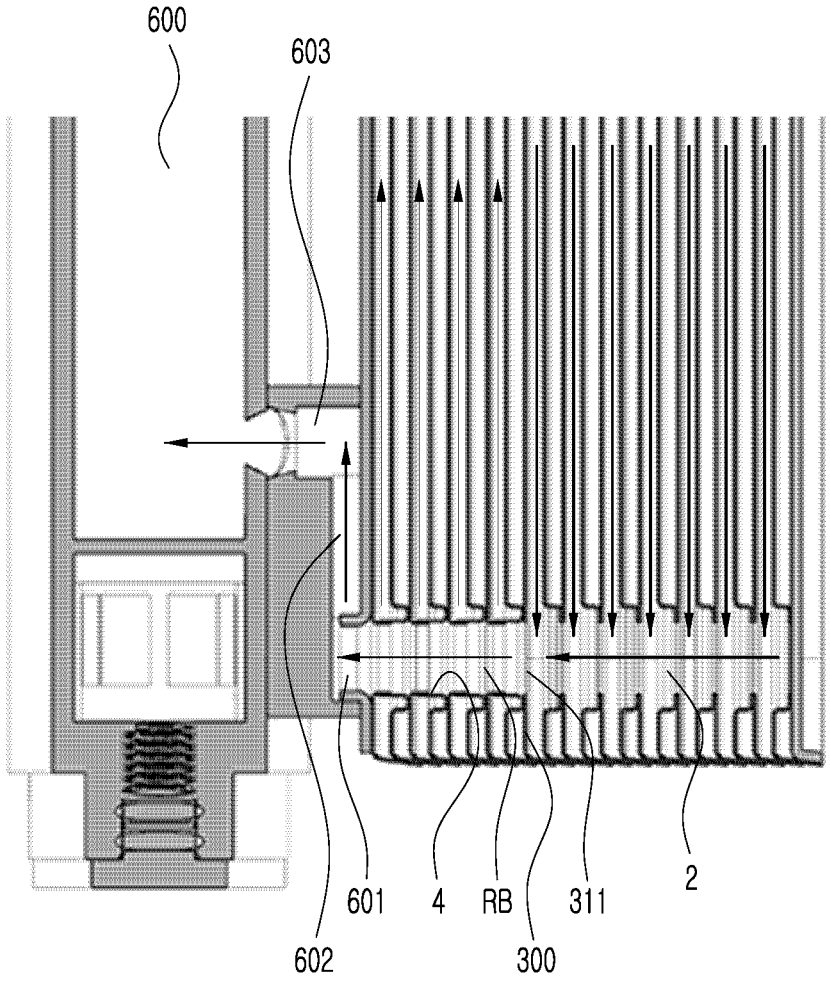

【FIG. 9】
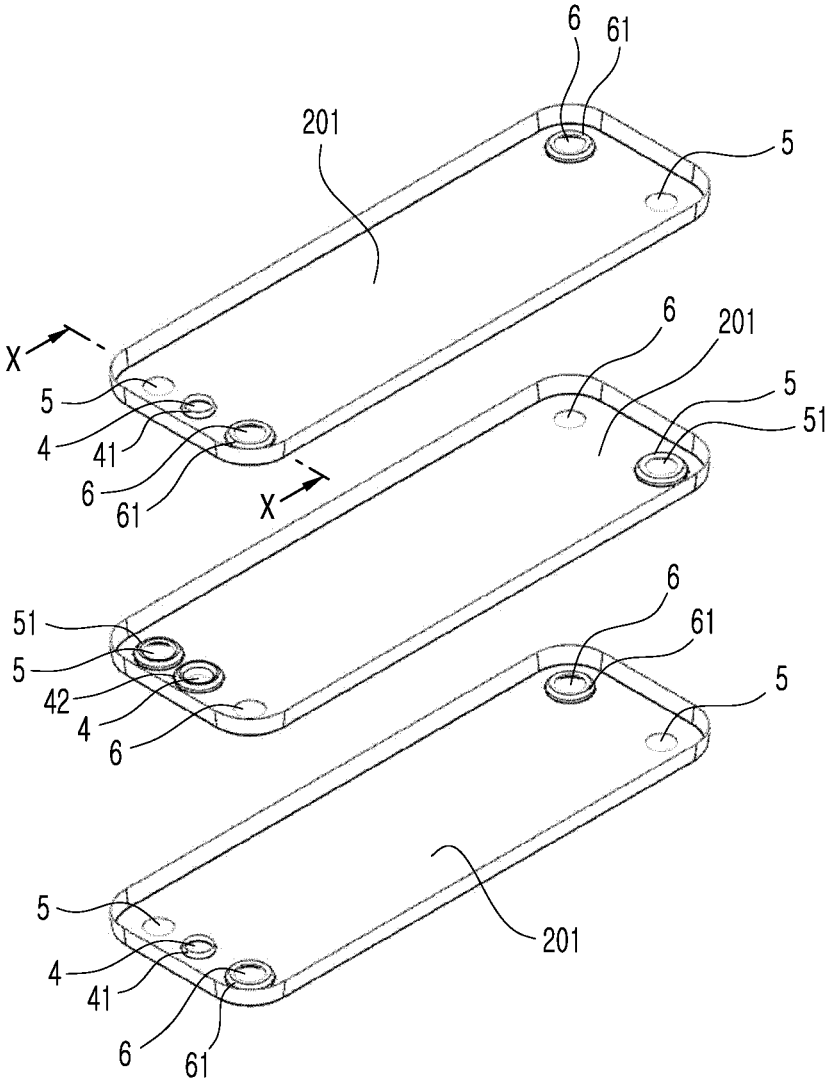

【FIG. 10】
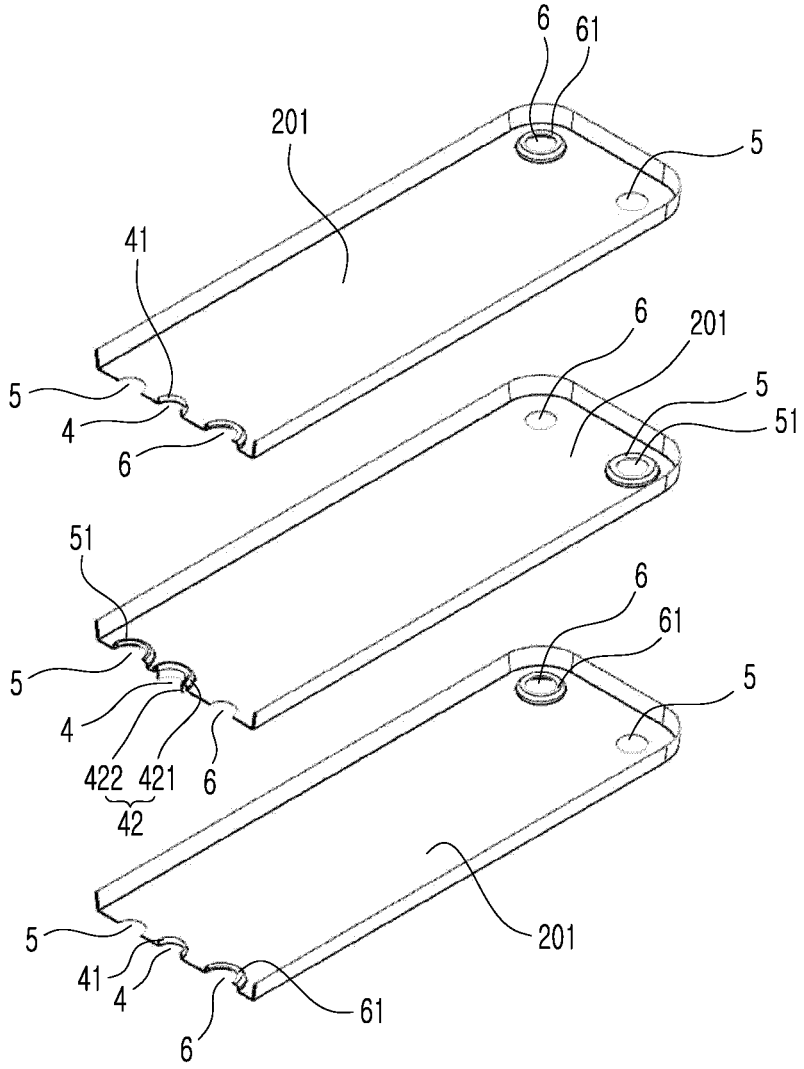

【FIG. 11】
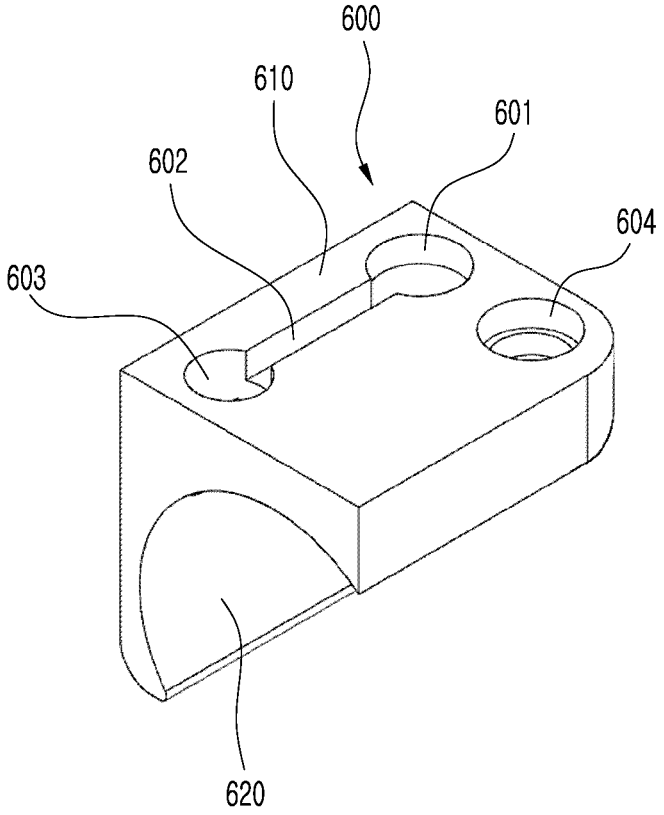

【FIG. 12】
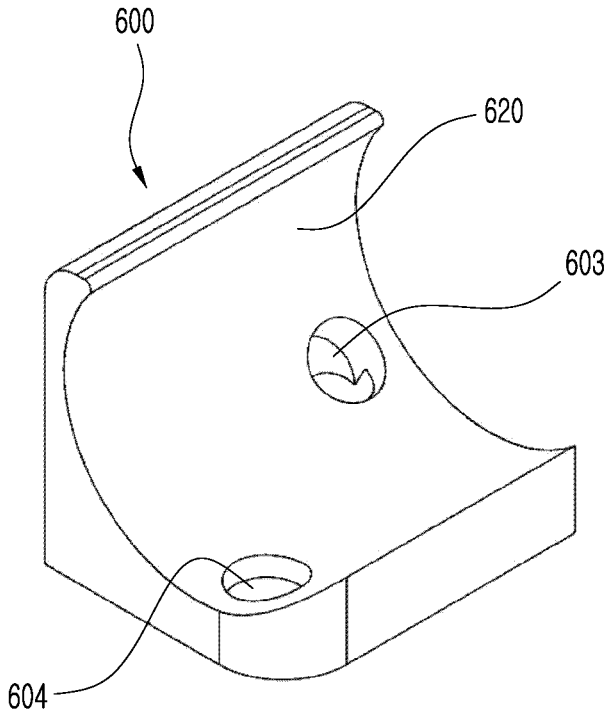
【FIG. 13】
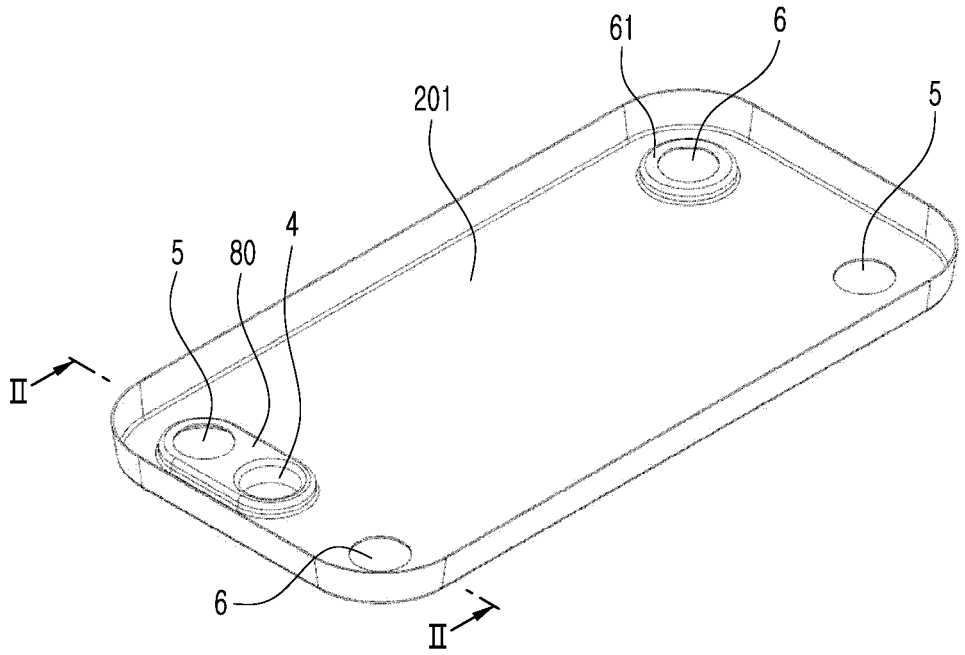

【FIG. 14】
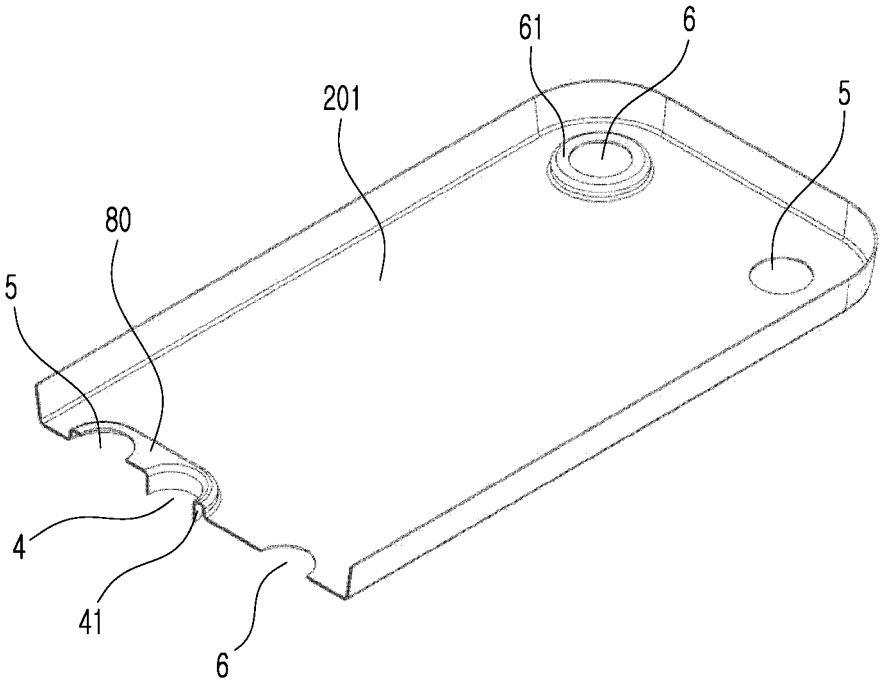

【FIG. 15】
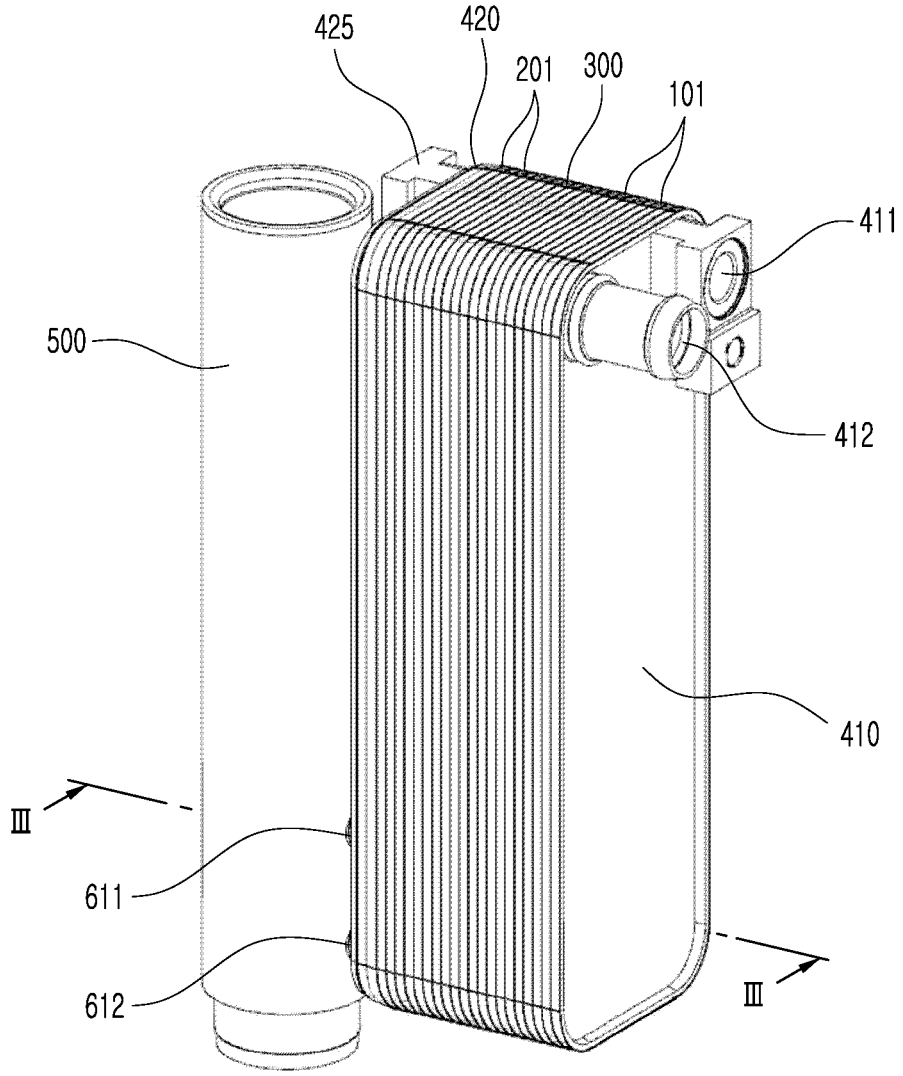

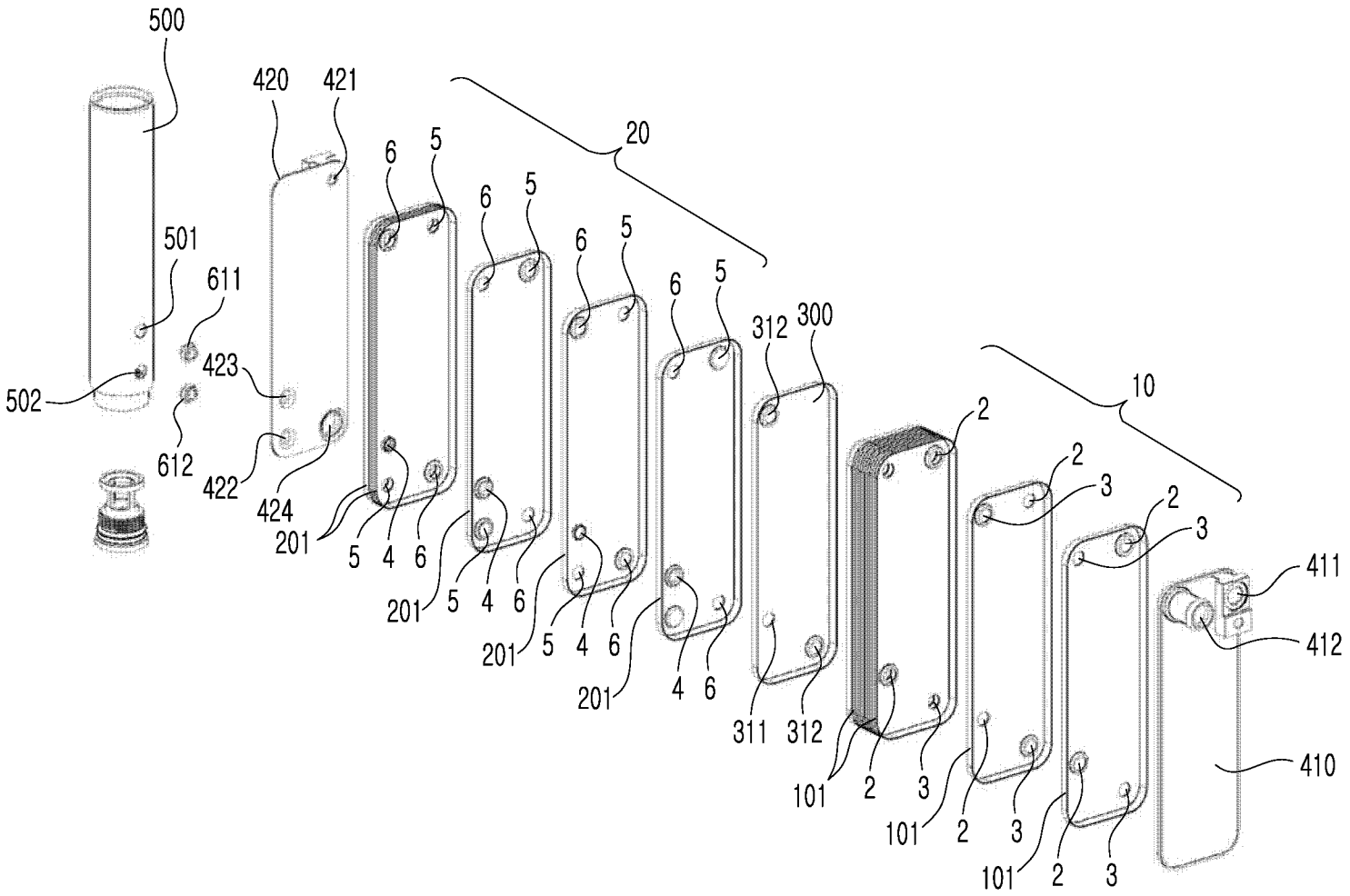
[FIG. 16]

【FIG. 17】
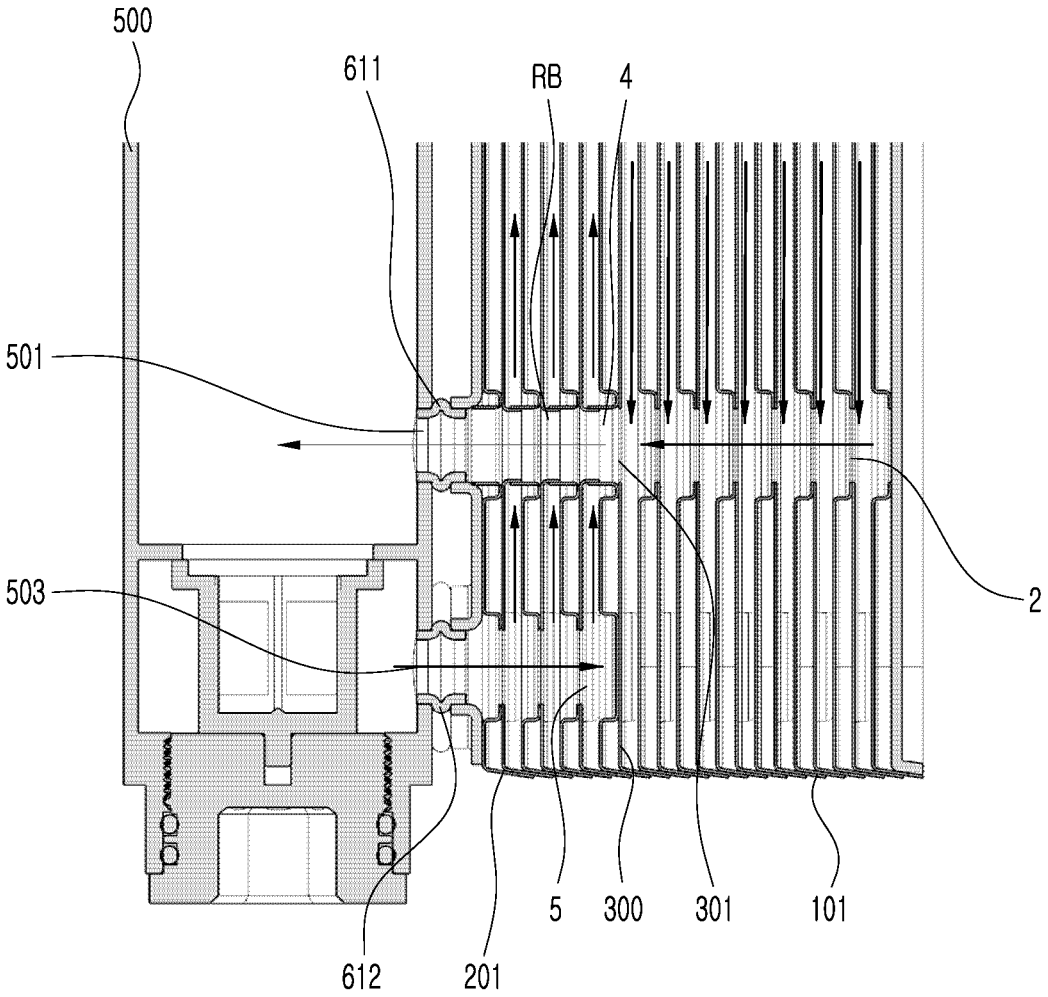

HEAT EXCHANGER FOR VEHICLE

CROSS REFERENCE TO RELATED APPLICATIONS

This application is a National Stage of International Application No. PCT/KR2021/014919 filed Oct. 22, 2021, claiming priority based on Korean Patent Application No. 10-2020-0139597 filed Oct. 26, 2020.

TECHNICAL FIELD

The present invention relates to a heat exchanger for a vehicle that is configured to perform heat exchange between liquid coolant and refrigerant.

BACKGROUND ART

A so-called liquid cooled heat exchanger is configured to exchange heat between a flow of liquid coolant and a flow of refrigerant. Such a heat exchanger may be used as a condenser that condenses the refrigerant by allowing heat of the superheated refrigerant to be transferred to the liquid coolant.

Due to limitations in improving the efficiency of internal combustion engines, thermal management is required to meet strict exhaust gas regulations. Compact packaging is required to improve the performance of vehicle heat exchangers despite the improvement of vehicle crash performance and the restrictions of layout inside the engine room. In addition, as the number of heat exchangers installed in a front end module (FEM) of a vehicle increases, thermal interference increases and the specifications of a fan motor increase, resulting in reduced fuel efficiency and increased unit cost. In particular, thermal efficiency management for increasing the driving mileage of electric vehicles is becoming more important, and the application of stacked plate type water-cooled heat exchangers as a solution to condensate condensation in heat pumps and as an auxiliary heat source for cabin heaters is increasing.

The heat exchanger includes a condensing unit in which heat is exchanged between the liquid coolant and the refrigerant, a receiver for temporarily storing the refrigerant condensed in the condensing unit, and a supercooling unit for further cooling the refrigerant discharged from the receiver. For the flow of the refrigerant, refrigerant passages connecting the condensing unit and the receiver and the receiver and the supercooling unit are required, and methods of forming the refrigerant passage through various means such as pipes, connecting blocks, and plates have been introduced. In particular, methods using a separate block or plate not only have problems of increasing the number of parts and increasing production cost, but also have limitations in reducing weight.

PRIOR ART DOCUMENTS

U.S. patent publication No. US2016-0320141 (2016 Nov. 3)

U.S. patent publication No. US2015-0226469 (2015 Aug. 13)

U.S. patent publication No. US2015-0323231 (2015 Nov. 12)

U.S. patent publication No. US2019-0063800 (2019 Feb. 28)

DETAILED DESCRIPTION OF THE INVENTION

Technical Problem

An object to be solved by the present invention is to provide a vehicle heat exchanger capable of forming a refrigerant flow path connecting a condensing unit and a receiver through a simple structure.

Technical Solution

According to an embodiment of the present invention, a heat exchanger for vehicles that performs heat exchange between a coolant and a refrigerant includes: a plurality of first stacked plates forming a condensing portion in which the refrigerant is condensed through heat exchange between the coolant and the refrigerant; a receiver container for storing the refrigerant passing through the condensing portion; a plurality of second stacked plates forming a subcooling portion for cooling the refrigerant through heat exchange between the coolant and the refrigerant discharged from the receiver container; and an intermediate plate interposed between the plurality of the first stacked plates and the plurality of the second stacked plates and comprising through holes through which the refrigerant and the coolant respectively move. The plurality of the second stacked plates form a refrigerant bypass passage for bypassing the refrigerant passing through the condensing portion and the through hole of the intermediate plate to the receiver container. The refrigerant bypass passage is formed in the form of a sealed passage by male-female coupling of male and female flanges respectively provided on the adjacent second stacked plates. The plurality of the second stacked plates form a through hole through which the refrigerant returned from the receiver container moves, and the refrigerant bypass passage and the through hole are disposed adjacent to each other in a lateral direction.

The heat exchanger may further include first and second cover plates respectively disposed outside the plurality of the first stacked plates and outside the plurality of the second stacked plates, and a connecting block fixing the receiver container to the second cover plate. The receiver container may include an inlet hole through which the refrigerant is introduced and an outlet hole that is formed at a position lower than the inlet hole and through which the refrigerant is discharged. The connection block may be configured such that the refrigerant introduced from the refrigerant bypass passage moves upwardly and is then supplied to the inlet hole so that the refrigerant is introduced to the inlet hole positioned at a position higher than the outlet hole and is then discharged to the outlet hole.

The female flange may include a protruding contact portion configured to be in contact with the facing second stacked plate, and an insertion portion extending from the protruding contact portion, and the male flange may be inserted into the insertion portion.

The second cover plate may include a through hole connected to the refrigerant bypass passage. The connecting block may include: a recessed groove communicating with the through hole of the second cover plate; a guide groove that is connected to the recessed groove and extends upwardly; and a through hole that extends toward the inlet hole of the receiver container at an upper end of the guide groove.

The plurality of the second stacked plates may form a through hole through which the refrigerant returned from the receiver container moves. The refrigerant bypass passage and the through hole through which the refrigerant returned from the receiver container moves may be disposed adjacent to each other in a lateral direction. The refrigerant bypass passage and the through hole through which the refrigerant returned from the receiver container moves may be formed on flanges connected to each other.

The intermediate plate may be configured to block at least a portion of the flow of the refrigerant flowing through the first stacked plate to change a direction of the flow and then to transfer the flow to the second stacked plate.

According to another embodiment of the present invention, a heat exchanger for vehicles that performs heat exchange between a coolant and a refrigerant includes: a plurality of first stacked plates forming a condensing portion in which the refrigerant is condensed through heat exchange between the coolant and the refrigerant; a receiver container for storing the refrigerant passing through the condensing portion; a plurality of second stacked plates forming a subcooling portion for cooling the refrigerant through heat exchange between the refrigerant discharged from the receiver container and the coolant; and an intermediate plate interposed between the plurality of the first stacked plates and the plurality of the second stacked plates and comprising through holes through which the refrigerant and the coolant respectively move. The plurality of the second stacked plates form a refrigerant bypass passage for bypassing the refrigerant passing through the condensing portion and the through hole of the intermediate plate to the receiver container. The refrigerant bypass passage is formed in the form of a sealed passage by male-female coupling of male and female flanges respectively provided on the adjacent second stacked plates. The plurality of the second stacked plates form a through hole through which the refrigerant returned from the receiver container moves. The refrigerant bypass passage is positioned to be higher than the through hole on the second stacked plate. The receiver container comprises an inlet hole through which the refrigerant is introduced and an outlet hole that is positioned to be lower than the inlet hole and through which the refrigerant is discharged. The heat exchanger further comprises an upper coupler that is provided at a height corresponding to the inlet hole and is connected to the refrigerant bypass passage and the inlet hole and a lower coupler that is provided at a height corresponding to the outlet hole and is connected to the through hole through which the refrigerant returned from the receiver container and the outlet hole.

Effect of the Invention

According to the present invention, by forming the refrigerant bypass flow passage by coupling the female flange and the male flange, the assembly process of the heat exchanger can be simplified and productivity can be improved. In addition, according to the present invention, since the connecting block for fixing the receiver container is configured such that the refrigerant moves upward and then flows into the receiver container, the manufacturing cost of the product can be reduced and the weight can be reduced.

BRIEF DESCRIPTION OF DRAWINGS

FIG. 1 is a perspective view of a heat exchanger for vehicles according to an embodiment of the present invention.

FIG. 2 is a rear perspective view of a heat exchanger for vehicles according to an embodiment of the present invention.

FIG. 3 is a side elevational view of a heat exchanger for vehicles according to an embodiment of the present invention.

FIG. 4 is an exploded perspective view of a heat exchanger for vehicles according to an embodiment of the present invention.

FIG. 5 is a drawing showing a flow of coolant of a heat exchanger for vehicles according to an embodiment of the present invention.

FIG. 6 is a drawing showing a flow of refrigerant of a heat exchanger for vehicles according to an embodiment of the present invention.

FIG. 7 is a sectional view taken along a line VII-VII in FIG. 1.

FIG. 8 is a sectional view taken along a line VIII-VIII in FIG. 1.

FIG. 9 is an exploded perspective view of second stacked plates of a heat exchanger for vehicles according to an embodiment of the present invention.

FIG. 10 is a sectional view taken along a line X-X in FIG. 9.

FIG. 11 is a perspective view of a connecting block of a heat exchanger for vehicles according to an embodiment of the present invention.

FIG. 12 is a rear perspective view of a connecting block of a heat exchanger for vehicles according to an embodiment of the present invention.

FIG. 13 is a drawing showing second stacked plates of a heat exchanger for vehicles according to an embodiment of the present invention.

FIG. 14 is a sectional view taken along a line II-II in FIG. 13.

FIG. 15 is a perspective view of a heat exchanger for vehicles according to another embodiment of the present invention.

FIG. 16 is a perspective view of a heat exchanger for vehicles according to another embodiment of the present invention.

FIG. 17 is a sectional view taken along a line III-III in FIG. 15.

EMBODIMENT OF THE INVENTION

Hereinafter, embodiments of the present invention will be described in detail with reference to the accompanying drawings.

A heat exchanger according to an embodiment of the present invention is shown in FIGS. 1 to 4. A vehicle heat exchanger according to an embodiment of the present invention is a water-cooled heat exchanger that cools a refrigerant using a liquid coolant. The vehicle heat exchanger may be configured to perform heat exchange between a refrigerant flow and a coolant flow, and may be configured to transfer heat of the refrigerant to the coolant so that condensation and subcooling of the refrigerant occur. For example, the heat exchanger can be applied as an auxiliary heat source for a passenger compartment heater in a vehicle.

The heat exchanger includes a plurality of stacked plates 101 and 201 made of metal such as aluminum. Each of the stacked plates 101 and 201 may have a substantially rectangular shape and may have a rim at an edge. The stacked plates 101 and 201 may be sequentially stacked so that their rims are in contact with each other to form a refrigerant space filled with a refrigerant and a coolant space filled with a coolant. The refrigerant space and the coolant space are fluidly separated from each other and configured to be alternately formed between the stacked plates 101 and 201, and the heat of the refrigerant is transferred to the coolant through the stacked plates 101 and 201. Hereinafter, a stacked plate indicated by reference numeral 101 is referred to as a first stacked plate, and a stacked plate indicated by reference numeral 201 is referred to as a second stacked plate.

An intermediate plate 300 is interposed between the plurality of first stacked plates 101 and the plurality of second stacked plates 201. A first cover plate 410 is disposed outside the plurality of first stacked plates 101 and a second cover plate 420 is disposed outside the plurality of second stacked plates 201. A receiver container 500 is fastened to the second cover plate 420 through a connection block 600. The plurality of first stacked plates 101 form a condensing portion 10 in which the refrigerant is condensed, and the plurality of second stacked plates 201 form a subcooling portion 20 in which the condensed refrigerant is further cooled.

A receiver container 500 may have a substantially hollow cylindrical shape forming a space filled with a refrigerant therein. The receiver container 500 is formed to store and discharge the refrigerant condensed in the condensation portion 10, and may include a desiccant material for removing vapor phase moisture from the refrigerant. The receiver container 500 is also called a gas-liquid separator in that it functions to remove gaseous substances from liquid refrigerant. Liquid refrigerant is discharged from the receiver container 500 and supplied to the subcooling portion 20.

The refrigerant flows into the condensing portion 10 through the first cover plate 410, fills the refrigerant space, passes through the intermediate plate 300 and the subcooling portion 20, and then flows into the receiver container 500. The refrigerant discharged from the receiver container 500 flows into the subcooling portion 20, fills the refrigerant space, and is discharged through the second cover plate 420. Meanwhile, the coolant flows into the subcooling portion 20 through the second cover plate 420, fills the coolant space, flows into the condensing portion 10 through the intermediate plate 300, fills the coolant space, and is then discharged through the first cover plate 410.

The first cover plate 410 includes a refrigerant inlet 411 for introducing refrigerant, and the first stacked plate 201 forms a through hole 2 for refrigerant flow. As shown in the drawing, the through hole 2 may be formed at a position adjacent to one side of the stacked plate 201 and a position adjacent to the opposite side, respectively. The intermediate plate 300 may form a through hole 311 for the movement of refrigerant, and the through hole 311 may be formed at a position opposite to the refrigerant inlet 411 of the first cover plate 410. At this time, each first stacked plate 201 has two through holes 2 for refrigerant movement, and the intermediate plate 300 is provided with a through hole 311 formed at position corresponding to one of the two through holes 2 for refrigerant movement. At this time, the intermediate plate 300 is configured to block at least a portion of the flow of the refrigerant flowing through the first laminated plate 201, convert the flow, and transfer the flow to the second stacked plate 301. To this end, the intermediate plate 300 is blocked at a position corresponding to one of the two through holes 2 of the first stacked plate 201 and has a through hole 311 formed at a position corresponding to the other of the two through holes 2, thereby changing the direction of flow of a portion of refrigerant flowing through the first stacked plate 201 to transfer to the second stacked plate 301. The second cover plate 420 may include a through hole 421 for discharging the refrigerant, a through hole 422 for discharging the refrigerant to the receiver container 500, a through hole 423 for receiving the refrigerant returned from the receiver container 500, and a through hole 424 for introducing coolant. The second cover plate 420 may include a refrigerant outlet 425 connected to the through hole 421 for discharging the refrigerant, and a coolant inlet 426 connected to the through hole 424 for introducing the coolant.

Meanwhile, a refrigerant bypass passage RB is formed to supply the refrigerant condensed in the condensing portion 10 to the receiver container 500 across the subcooling portion 20. The refrigerant bypass passage RB is formed to be fluidly sealed from the refrigerant space and the coolant space of the subcooling portion 20, and is formed to pass through the subcooling portion 20 to interconnect the through hole 311 of the intermediate plate 300 and the through hole 422 of the second cover plate 420. As a result, the refrigerant condensed in the condensing portion 10 may be supplied to the receiver container 500 through the refrigerant bypass passage RB. The refrigerant discharged from the receiver container 500 is returned to the subcooling portion 20 through the through hole 423 of the second cover plate 420, and the refrigerant returned to the subcooling portion 20 fills the refrigerant space while moving passing through the through hole 5 and is discharged again through the through hole 421 of the second cover plate 420 and the outlet 425.

FIG. 5 shows the coolant flow (dotted arrow) of the vehicle heat exchanger according to an embodiment of the present invention, and FIG. 6 shows the refrigerant flow (dotted arrow) of the vehicle heat exchanger according to an embodiment of the present invention.

First, referring to FIG. 5, the coolant is introduced into the subcooling portion 20 through the inlet 426 and the through hole 424 of the second cover plate 420, and fills the coolant space of the subcooling portion 20 while moving through the through hole 6. At this time, the through holes 6 may be formed near opposite sides of the second stacked plate 201, one of which is located at a position corresponding to the through hole 424 of the second cover plate 420. The intermediate plate 300 forms a through hole 312 formed at a position corresponding to the through hole 6 of the second stacked plate 201 through which the coolant passes, and the coolant is introduced into the condensing portion 10 through the through hole 312. The coolant fills the coolant space of the condensing portion 10 while moving through the through hole 3 formed in the first stacked plate 101. At this time, the through hole 3 of the first stacked plate 101 may be formed at a position corresponding to the through hole 312 of the intermediate plate 300 through which the coolant passes, and the coolant outlet 412 of the first cover plate 410 may be formed at a position corresponding to one of the two through holes 3 of the first stacked plate 101 through which the coolant passes.

Meanwhile, referring to FIG. 6, the refrigerant is introduced into the condensing portion 10 through the refrigerant inlet 411 of the first cover plate 410. The introduced refrigerant moves through the through hole 2 of the condensing portion 10 to pass through the condensing portion 10, and the condensed refrigerant is bypassed to the receiver container 500 via the refrigerant bypass passage RB and the through hole 422 of the second cover plate 420. The refrigerant discharged from the receiver container 500 is introduced into the subcooling portion 20 via the through hole 423 of the second cover plate 420, and the introduced refrigerant passes through the subcooling portion 20 while moving through the through hole 5 of the second stacked plate 201. The refrigerant passing through the subcooling portion 20 fills the refrigerant space and moves through the through hole 5 on the opposite side of the second stacked plate 201 to be discharged through the through hole 421 of the second cover plate 420 and the outlet 425.

As mentioned above, in the condensing portion 10 and the subcooling portion 20, the refrigerant space and the coolant space are alternately formed between the adjacent stacked plates 101 and 201, and for this purpose, a protruding flange 61 surrounding the through hole 6 of the second stacked plate 201 through which the coolant passes, a protruding flange 51 of the second stacked plate 201 surrounding the through hole 5 through which the refrigerant passes, a protruding flange 21 surrounding the through hole 2 of the first stacked plate 101 through which the refrigerant passes, and a protruding flange 31 surrounding the through hole 3 of the first stacked plate 101 through which the coolant passes are formed alternately. The protruding flange 61 of the second stacked plate 201 is in contact with the facing surface of the next second stacked plate 201, whereby the coolant is not filled in the space between the corresponding two second stacked plates 201, that is, the refrigerant space. Similarly, protruding flanges 31 surrounding the through holes 3 of the neighboring first stacked plate 101 through which the coolant passes are alternately formed. Similarly, protruding flanges 21 and 51 surrounding the through holes 2 and 5 of the neighboring first and second stacked plates 101 and 201 through which the refrigerant passes are alternately formed. Accordingly, the refrigerant space and the coolant space may be alternately formed.

The refrigerant bypass passage RB is formed by male-female coupling of a male flange 41 and a female flange 42 respectively forming the through hole 4 described above. Referring to FIGS. 7, 9 and 10, the male flange 41 and the female flange 42 are alternately formed on the second stacked plates 201 arranged in sequence, and the refrigerant bypass passage RB fluidically sealed from the space between the second stacked plates 201 is formed by male-female coupling of the male flanges 41 and the female flanges 42. The male flange 41 is formed to protrude toward the second staked plate 201 having the female flange 42. The female flange 42 includes a protruding contact portion 421 that protrudes toward the facing stacked plate 201 and a receiving portion 422 that protrudes from the protruding contact portion 421 in an opposite direction and is configured to receive the male flange 41. The male flange 41 and the receiving portion 422 may have a corresponding hollow cylindrical shape, and the male flange 41 may be inserted into the receiving portion 422 in a fluid-tight manner. As a result, as shown in FIG. 7, a tubular portion is formed by continuous coupling of the male flange 41 and the female flange 42, thereby forming the refrigerant bypass passage RB. According to an embodiment of the present invention, there is no need for a separately inserted tubular member to bypass the refrigerant, and the refrigerant bypass flow path is formed by the male-female coupling of the male and female flanges 41 and 42 provided in the second stacked plate 201 in a simple structure.

The second cover plate 420 is fixed to the plurality of the second stacked plates 201, and a connecting block 600 connects the receiver container 500 to the second cover plate 420. For example, the receiver container 500, the connecting block 600, and the second cover plate 420 may be fixed to each other through brazing. The connecting block 600 is configured to form an inflow passage through which refrigerant flows into the receiver container 500 and an outflow passage through which refrigerant is discharged from the receiver container 500. Referring to FIGS. 8, 11 and 12, the inflow passage may be formed by a recessed space 601 on a surface 610 of the connecting block 600 to face the second cover plate 420, a guide groove 602 that is connected to the recessed space 601 and is formed on the surface of the connecting block 600 to extend upward, and a upper through hole 603 that is connected to an upper end of the guide groove 602 and is penetrated to a contact surface 620 of the connecting block 600 contacting the receiver container 500. The discharge passage may be implemented by a lower through hole 604 disposed adjacent to the recessed space 601 in a lateral direction. The upper through hole 603 may communicate with an inlet hole 501 of the receiver container 500 and the lower through hole 604 may communicate with an outlet hole 502 of the receiver container 500. According to an embodiment of the present invention, the receiver container 500 is fixed by a connection block 600, which is a single member, and the connection block 600 is configured such that a position where the refrigerant flows into the receiver container 500 is higher than a position where the refrigerant is discharged therefrom.

FIGS. 13 and 14 show a second stacked plate of a vehicle heat exchanger according to another embodiment of the present invention. According to this embodiment, a through hole 4 for bypassing the refrigerant to the receiver container 50 and a through hole 5 through which the refrigerant returned from the receiver container 50 passes are surrounded by a single protruding flange 80. That is, the adjacent through holes 4 and 5 are surrounded by flanges 80 connected to each other. Compared to the case where the two through holes are formed on separate flanges, since the two through holes 4 and 5 are formed on the flange 80 having two portions connected to each other, manufacturing is easy and contact property to the next adjacent stacked plate 21 is improved with the flange 80 having a single height so that fluid sealing properties can be improved.

FIGS. 15 to 17 show a vehicle heat exchanger according to another embodiment of the present invention. The same reference numerals are used for the same parts as those of the above-described embodiment, and repeated descriptions are omitted. In this embodiment, in order to connect the second cover plate 420 and the receiver container 500, two couplers 611 and 612 are used instead of a connection block. Referring to FIGS. 16 and 17, two couplers 611 and 612 are vertically arranged to correspond to positions of the inlet hole 501 and the outlet hole 502 of the receiver container 500. Accordingly, the through hole 4 of the second stacked plate 201 communicating with the coupler 611 disposed above is disposed above the through hole 5 of the second stacked plate 201 communicating with the coupler 612 disposed below.

Although preferred embodiments of the present invention have been described in detail above, the scope of the present invention is not limited thereto, and various modifications and improvements by those skilled in the art using the basic concept of the present invention as defined in the following claims are also within the scope of the invention.

INDUSTRIAL APPLICABILITY

The present invention can be applied as a heat exchanger for vehicles to have an industrial applicability.

The invention claimed is:

1. A heat exchanger for vehicles that performs heat exchange between a coolant and a refrigerant, comprising:

a plurality of first stacked plates forming a condensing portion in which the refrigerant is condensed through heat exchange between the coolant and the refrigerant;

a receiver container for storing the refrigerant passing through the condensing portion;

a plurality of second stacked plates forming a subcooling portion for cooling the refrigerant through heat exchange between the coolant and the refrigerant discharged from the receiver container;

an intermediate plate interposed between the plurality of the first stacked plates and the plurality of the second stacked plates and comprising a first through hole through which the refrigerant moves and a second through hole through which the coolant moves; and first and second cover plates respectively disposed outside the plurality of the first stacked plates and outside the plurality of the second stacked plates, wherein the plurality of the second stacked plates form a first bypass passage for bypassing the refrigerant passing through the condensing portion and the first through hole of the intermediate plate to the receiver container, and a second bypass passage through which the refrigerant returned from the receiver container moves, wherein each of the first and second bypass passages are formed as a sealed passage by male-female coupling of male and female flanges respectively provided on adjacent second stacked plates, wherein the first bypass passage is positioned to be higher than the second bypass passage on the plurality of the second stacked plates, wherein the receiver container comprises an inlet hole through which the refrigerant is introduced and an outlet hole that is positioned to be lower than the inlet hole and through which the refrigerant is discharged, and wherein the heat exchanger further comprises:

an upper coupler provided at a height corresponding to the inlet hole and horizontally connecting the first bypass passage directly to the inlet hole; and a lower coupler provided at a height corresponding to the outlet hole and horizontally connecting the second bypass passage directly to the outlet hole.

2. The heat exchanger for vehicles of claim 1, wherein the female flange comprises a protruding contact portion configured to be in contact with a facing second stacked plate, and an insertion portion extending from the protruding contact portion, and wherein the male flange is inserted into the insertion portion.

3. The heat exchanger for vehicles of claim 1, wherein the intermediate plate is configured to block at least a portion of a flow of the refrigerant flowing through the first stacked plates to change a direction of the flow and then to transfer the flow to the second stacked plates.

* * * * *